US006294209B1

(12) United States Patent
Andersson

(10) Patent No.: US 6,294,209 B1
(45) Date of Patent: Sep. 25, 2001

(54) AROMATIZED FOOD PACKAGE

(75) Inventor: Bo Andersson, Oxie (SE)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 09/451,007

(22) Filed: Nov. 29, 1999

Related U.S. Application Data

(63) Continuation-in-part of application No. 09/086,045, filed on May 28, 1998, now abandoned.

(51) Int. Cl.[7] ..... A23L 3/3418; B65D 81/28

(52) U.S. Cl. ..... 426/115; 426/119; 426/394; 426/404

(58) Field of Search ..... 426/106, 112, 426/116, 119, 129, 392, 404, 115, 394; 428/905; 512/1–5

(56) References Cited

U.S. PATENT DOCUMENTS

| | | | | |
|---|---|---|---|---|
| 2,357,258 | * | 8/1944 | Harris | 99/172 |
| 2,705,579 | * | 4/1955 | Mason | 222/129 |
| 4,034,116 | | 7/1977 | Hamell et al. | 426/131 |
| 4,069,351 | * | 1/1978 | Yano et al. | 426/650 |
| 4,158,708 | * | 6/1979 | Chiovini et al. | 426/650 |
| 4,471,871 | * | 9/1984 | Rockliffe et al. | 206/205 |
| 4,717,017 | | 1/1988 | Sprinkel et al. | 206/264 |
| 4,990,345 | | 2/1991 | Webb | 426/123 |
| 5,297,732 | | 3/1994 | Hahn | 239/55 |
| 5,417,993 | * | 5/1995 | Takano et al. | 426/312 |
| 5,510,134 | * | 4/1996 | Simon et al. | 426/424 |
| 5,688,545 | * | 11/1997 | Sanders | 426/120 |
| 5,885,640 | | 3/1999 | Andersson | 426/316 |
| 5,976,595 | * | 11/1999 | Ganguli et al. | 426/417 |
| 6,045,833 | * | 4/2000 | Landau | 426/2 |
| 6,066,347 | * | 5/2000 | Prasad et al. | 426/107 |

FOREIGN PATENT DOCUMENTS

| | | | |
|---|---|---|---|
| 3110847 | 9/1982 | (DE) | B65D/81/34 |
| 0706944 | 4/1996 | (EP) | B65B/25/00 |
| 0814023 | 12/1997 | (EP) | B65B/25/00 |
| 2242890 | 10/1991 | (GB) | B65D/1/36 |

OTHER PUBLICATIONS

Food Chemistry 3rd Edition Owen Fennema Marcel Dekker Inc NY p. 724, 1996.*

Database Abstract, Derwent Information Lt., WPI Accession NO. 82–NO 112E/198240, Abstract of Gork, German Patent Application Publication No. DE 31 10847 A1 (1982).

* cited by examiner

*Primary Examiner*—Keith Hendricks
*Assistant Examiner*—Drew Becker
(74) *Attorney, Agent, or Firm*—Vogt & O'Donnell, LLP

(57) ABSTRACT

An aromatized food package is provided by providing a package body member part which defines a first and second cavity, inserting a food product into the first cavity, dosing a liquid mixture of food-acceptable aroma and a carrier consisting essentially of low boiling point solvent, into the second cavity, pulling a vacuum within at least the second cavity to cause the solvent in the second cavity to substantially evaporate while leaving aroma composition within the cavity, and sealing the cavities with a cover so that the cavities are separated one from the other and which, when removed, opens both cavities.

18 Claims, 2 Drawing Sheets

AROMATIZED FOOD PACKAGE

CROSS-REFERENCE TO RELATED APPLICATION

Figure 1A:
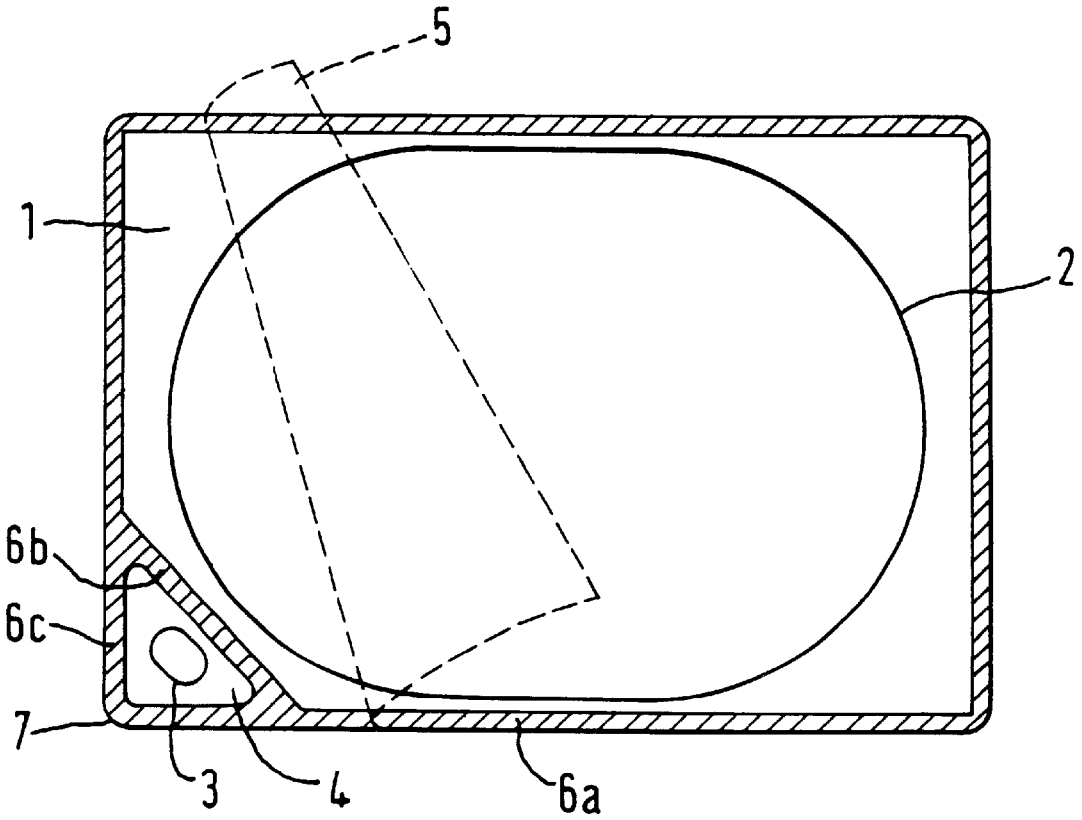

This application is a continuation-in-part application of Application Serial No. 09/086,045 which was filed May 28, 1998 and which is now abandoned.

BACKGROUND OF THE INVENTION

The present invention relates to packages which contain a food product and an additional aroma component and the manufacture thereof so that, upon opening the package, the consumer will smell the aroma.

It is disclosed in the food art that it is, in some cases, desirable to add an aroma composition to the headspace of a package containing a food product to increase and to stress an olfactory sensation, the smell, of freshness and the uniqueness of the food product so that upon opening the package, a consumer's appetite will be whetted.

A system for aromatising a headspace of a food package is disclosed in European Patent Application Publication No. 0 706 944, wherein an aroma composition is dissolved in a liquid, and then the aromatized liquid is dispensed in a gaseous form into the headspace, such as by, for example, means of a spray nozzle, or by other dispenser suitable for introducing the liquid into the headspace.

Another system for aromatising a headspace of a food package is disclosed in European Patent Application Publication No. 0 814 023. In this system, a noble gas, such as argon, or an inert gas, may be employed for introducing an aroma composition, which is soluble in or mixable with the gases, into a package headspace. This system allows for a direct mixing of gases such as carbon dioxide or nitrogen or mixtures thereof, which are employed conventionally for modifying a package atmosphere, and which may be accomplished with a gas mixer via mixing pre-selected proportions of the components to obtain an aromatized gas mixture which then is injected into packages using gas packing machines known in the art.

Although the systems discussed above and although others known in the art may provide an enhanced olfactory perception upon the opening of a package so aromatized, in some cases, however, certain types of food products and certain types of aroma compositions may be incompatible when co-packed in the same space. Significantly, too, co-packing of a food product and an added aroma composition together in the same space may result in the aromas provided by the aroma composition being absorbed by the food product, even within a few days of packing, which will result in, relatively in the context of the aroma-producing potential of the aroma composition employed, reduced aroma impact upon package opening and may result, in turn over a period of storage, in there being almost no excess aroma present in the headspace for release for user perception upon package opening. So, too, if the aroma composition is dissolved in a solvent introduced into a headspace, the solvent may dissolve in the food product, which likewise will tend to reduce the aroma impact sought to be achieved upon package opening. Further, because an amount of headspace aroma absorption may differ from lot-to-lot of commercially manufactured products, and even possibly from unit-to-unit of a same lot (or batch), there is chance of, upon package opening, variability between the aroma strength perceived by the user/consumer from a plurality of packages.

SUMMARY OF THE INVENTION

The present invention provides an alternative to the above-noted ways of giving the consumer, upon opening a packaged food or beverage product, an olfactory perception of freshness and uniqueness of the product without added, or excess, aroma being present in the headspace of the package, although such is not intended to be excluded.

To that end, the present invention provides an air-tight package, i.e., a package sealed from the ambient atmosphere, which substantially reduces a chance, if not substantially avoiding a chance, for the above-noted lot-to-lot and unit-to-unit aroma strength perception differences. Moreover, because the embodiments of the present invention avoid absorption of an added, or excess, aroma component, it is believed that, in general, lesser dose amounts of aroma composition per package unit may be employed as compared with headspace aromatization, and that, it is believed, is not an insignificant consideration in the context of the economics of aroma composition preparation and use.

The invention also provides an aromatized food-containing package wherein a chance or risk of contact between the aroma composition with either the food product or the consumer is limited and sought to be avoided. For example, even if food-acceptable aroma compositions are employed, it is not desirable to have direct contact with the aroma composition since the aroma composition is provided at relatively high concentration. That is, direct contact with a concentrated aroma composition can result in a very strong and undesirable smell on the hands of a consumer or on a portion of the food product. Therefore, the present invention also provides an air-tight package which also reduces the chance of, and substantially avoids, if not totally avoiding the chance of, direct contact of the aroma composition with either the food product or the consumer.

According to the invention, a food or beverage product and a food-acceptable aroma composition are isolated in separate compartments of a package until the package is opened, and upon opening of the package, aromas from an aroma composition maintained in a compartment are released to effect a desired consumer perception, and generally, it will be the case that the aroma(s) released will mix with aroma emanating from the food, or beverage, itself and provide a desirable combined aroma. Further accordance with the present invention, there may be a plurality of aroma compositions maintained in cavities separate from one another to enhance a mixing effect. Additionally, it has been observed that in the case of a package which comprises a peelable web package cover part, the peeling of the web for opening of the package is believed to facilitate aroma mixing just above the opened package, which operates to attract, in a favorable way, the attention of the person opening the package to the product.

In a first aspect, the present invention provides a food package having a configuration. i.e., structure, which defines a first cavity, which is suitable for containing a food product, and a second cavity which is suitable for containing a food-acceptable aroma composition, the first and second cavities being sealed separate and apart by a cover part which, when removed, opens both cavities and wherein the aroma composition is such that and in an amount effective so that upon package opening, aromas are released from the aroma composition-containing cavity, and preferably, substantially all of the aroma potential of the aroma-containing composition is released for consumer perception.

In another aspect, the present invention provides a process for preparing a packaged food product comprising:

providing a package body part which defines a cavity for containing a food product as defined above;

inserting a food product into the cavity;

dosing a liquid mixture of a food-acceptable aroma composition and a liquid carrier into a portion of the package body part separated and apart from the part which contains the food product;

removing the liquid carrier from the aroma composition, preferably by evaporating the carrier, while leaving aroma composition preferably in a form of a residue, preferably comprising a solidified form, so that aromas are released from the package upon opening the package; and covering and sealing the package body part with a cover part so that the food product and aroma composition are sealed and contained within the package separate and apart one from the other and from the atmosphere within separate package cavities and so that the cover part is removable and so that when the cover part is removed, the separate cavities are opened to the atmosphere.

DETAILED DESCRIPTION OF THE INVENTION

In line with the description above, the present invention provides means for obtaining an aromatized packaged product (herein defined as being a packaged product having an added/excess aroma component beyond that provided by or capable of being provided by the basic product packaged and intended for consumption) wherein a very small amount of an aroma composition is present in a package cavity separate and apart from the basic product, this being effected by dosing a carrier which contains an aroma composition into the package at a position separate and apart from a cavity containing the food product and then removing, and preferably at least substantially eliminating, the carrier from the package, wherein the amount of aroma composition present in the cavity after solvent removal is sufficient, i.e., effective, to provide an olfactory perception beyond that provided by the food product contained by the package. Preferably, the carrier and aroma mixture is dosed in a cavity pre-formed in a package body. However, in an embodiment as noted below, the mixture may be dosed on a package body flange surface and an aroma-containing cavity may be formed between the package cover part and a flange surface.

As a result of the removal of the carrier, which in the practice of the process has a liquid i.e., fluid, form, preferably substantially only aroma composition remains in the cavity, and the aroma composition is selected so that under the conditions of packaging and after carrier removal, at least a part, and preferably substantially all of it is in a solidified residue form, as opposed to a liquid or fluid form, and as noted further below, it has been found that when operating in accordance with the process of the present invention, the aroma composition residue is not substantially visibly perceptible to the user/consumer. Hence, the process is best carried out so that any carrier or residue thereof which may remain is likewise not substantially visually perceptible to the user/consumer. However, in the context of the present invention and use of a liquid carrier, detectable or visual presence of the carrier or aroma composition is not precluded as long as the carrier or aroma composition present upon package opening is not fluid and flowable under conditions of standard atmospheric and pressure conditions.

Further in the context of the foregoing, because of the carrier-removal step of the process of the present invention, it is possible to envisage use of a non-food-acceptable liquid carrier since, without the presence of liquid, the package may be manipulated in any way, including turning it up-side-down, such as for transferring the food product to a dish or a pan, without resulting in carrier falling out from the cavity and being integrated with the food. Additionally, since the presence of a carrier in the package is not necessary at the time of the opening of the food package for consumption of the food product, no special package construction is necessary to retain such as a solid carrier, be it in a particulate form or otherwise, should the package be turned, for example, upside-down.

In carrying out the process the invention with a liquid carrier, so that removal of the carrier may be effected, the carrier preferably is selected from among solvents having a boiling point at or lower than 100° C. at standard atmospheric pressure (herein referred to as "low-boiling point solvents") which enables carrying out procedures for carrier evaporation, or volatilization, readily. Low-boiling solvents which boil at ambient temperature, i.e., at about normal room temperature (i.e., approximately 20° C.), under the vacuum conditions, i.e., pressure less than standard atmospheric pressure, are preferred. The preferred low-boiling point solvents include water, but preferably are such as ethanol, methylformate, ethylformate, propanol and hexane. Among the noted solvents, those that are recognized by food regulations as being "food grade" which allows food packaging use, are preferred, and of those, ethanol is particularly preferred.

Boiling points of above-noted solvents at differing pressures are set forth in the accompanying Table.

TABLE

| Solvent | Boiling Point (° C.) At pressure of 1 bar | At pressure of 0.05 bar |
|---|---|---|
| Ethanol | 78.5 | 19 |
| Methylformate | 32 | −28 |
| Ethylformate | 54.3 | −11 |
| Propanol | 97 | 36 |
| Hexane | 69 | −2.5 |

In accordance with the process of the present invention, preferably, removal of liquid solvent carrier from a cavity dosed with low-boiling solvent containing an aroma composition is effected by pulling a vacuum (i.e., effecting a pressure less than atmospheric pressure) so that the solvent evaporates, i.e., vaporizes. As will be appreciated, the procedure using reduced pressure enables removal of the carrier at a temperature below a temperature at which the carrier vaporizes and thereby evaporates at standard atmospheric and pressure conditions, and it has been found that so proceeding will provide for retention of, and hence, the preservation of, the aroma composition in the package as a non-fluid residue in the aroma cavity. Moreover, not only is that residue retained, but it also has been found that process is carried out readily and that the objectives are achieved with amounts of aroma composition which, after solvent/carrier removal, result in a residue which is not substantially visually perceptible, but which yet is in a concentration, or amount, effective to provide the intended olfactory effect upon opening the package. Further, as will be appreciated, depending upon the chemical formulation of the aroma composition, the volatility of the aroma composition may be such that an amount of it may be present in the sealed package aroma cavity in an aerosol, or gaseous/volatile, form rather than as only a residue.

In sum, the liquid carrier as described above is one which evaporates under the conditions of reduced pressure employed and the aroma composition or compositions employed is/are preferably such that it/they form a residue or otherwise solidify under the conditions of the reduced-pressure packaging and are such that it/they become(s) volatile and gaseous, preferably readily, upon package opening when under standard conditions of temperature and pressure, i.e., atmospheric conditions and a temperature of about 20° C.

More particularly with regard to carrying out the process described above, an aroma composition is dissolved in or mixed with a liquid carrier, preferably at ambient temperature and atmospheric pressure, and then that combination is dosed, preferably into an already formed package cavity, or otherwise, so that, upon cover placement, it will be contained in a package cavity, the dosing being carried out by means of a pump, such as a peristaltic pump, or by means such as spraying or other means known to those skilled in the art for dosing solvent substances such as the low boiling point solvents of the invention.

Advantageously, and preferably, the dose amount ranges from about 3 to 50 microliters, preferably from about 5 to 10 microliters. The aroma composition, which itself may be introduced into the carrier in a liquid form, may be present, depending upon its composition and aroma-giving potential, in an amount of from only 1 to 10% by volume of the dose. In any event, the amount of aroma composition employed should be of a kind and amount effective and so that it is volatively effective for olfactory response when a cover is peeled off the package so that the consumer will perceive readily the fragrance coming from the aroma composition-containing cavity and not detect visually the presence of substances in that cavity, whether the product be heated or chilled or at ambient temperature when the package is opened.

For solvent removal, the reduced pressure (vacuum) which may be drawn may be on the order of not higher than about 0.1 bar and preferably lower and more preferably 0.05 bar and lower. Further, in the process of the invention, from the time of employing reduced-pressure (vacuum) conditions for solvent removal, such reduced-pressure conditions preferably are maintained for the remainder of packaging operation through package cover part placement and sealing which provides and maintains the food product and aroma-containing cavities separate and apart one from the other and impervious to the atmosphere.

In accordance with the invention, the package body preferably is enclosed by a unitary cover which is sealed onto the package body part so that food-and aroma-containing cavities are imperviously and individually closed, and a particular embodiment of the package of the invention comprises a package which comprises a package body member part and a package cover member part wherein the body member part is configured to define a first and second cavities for containing, respectively (i) a product selected from the group consisting of food and beverage products and for being covered by the cover member part and (ii) a dose of food acceptable aroma positioned within the second cavity for being covered by and sealed to the cover member part by a non-reclosable sealing means, wherein the dose of food-acceptable aroma consists essentially of an aroma selected from the group consisting of dry and aerosol forms, wherein the dose of food acceptable aroma is packaged within the cavity into an atmosphere selected from the group consisting of sub-atmospheric pressure and modified atmosphere pressure with flushed inert gas.

In the present context, the cavity for containing the aroma composition may be a spaced formed between two package body part flanges which are integrated with the structure of the package body for containing the food product, or it may be an indentation formed in the package body. However, it also may be an un-sealed area between a flange surface and the cover part or between two abutting sheets sealed together to define an un-sealed area which forms a cavity.

In a preferred embodiment of the invention, the package comprises a body for containing the product such as a thermo-formed tray which defines first and second cavities such as by means of a wall or walls which provide a flange or flanges, and the cavities are covered by a peelable web cover part. Advantageously, the first cavity is defined by a tray with an upper flange portion and the second cavity is formed in the upper flange portion, and positioning of the cavity at a corner of the package is preferred. In an alternative embodiment, the dose is dosed directly onto a surface provided by the flange which extends from a body wall, and after removing the carrier, a web material then is sealed around and over the dose so that a second cavity is formed between the flange surface and web cover to isolate the aroma dose from the food product in the package.

The package cover part which may be a web, or sheet, as indicated above, may be comprised of materials known as being suitable for covering and sealing package bodies which contain food, and means for sealing are provided so that the cover part is peelable and sealed to a package body so that the aroma composition and the food product in the cavities are sealed one from the other. The web material is advantageously of plastic or plastic laminate, conveniently, thermo-formable plastic of conventional type and such as may be used for aromatized headspace packaged products.

In the context of cover part sealing, such as with a food-acceptable adhesive as is known in the food packaging art, preferably, the cavities are sealed imperviously one from the other so that no aroma passes or migrates through the seal to the cavity containing the food product, and it is preferred that the cover be sealed such that upon opening of the food product-containing cavity, the aroma-containing cavity also opens. Therefore, when a consumer removes the cover confirming the cavity with the food product, aroma from the food product is released, and since the opening of that cavity also results in the opening of the other cavity, the aroma from the aroma composition cavity also will be released and mixed with the aroma from the food product. In sum, the package body and cover are configured preferably such that no matter which cavity is opened first, the other one also will open.

The food product packaged may comprise any of a plurality of foods and includes, for example, a charcuterie product such as sliced meat or sausage, or it may be a dough or a biscuit product, or a combined dough, meat and sauce product, for example pies, and the product may advantageously be a chilled product, e.g. charcuterie, packed in a modified atmosphere for instance in a pouch, or it may be a product suitable for ambient storage, e.g. a confectionery product such as biscuits.

Further in the context of the description above, the food-acceptable aroma may be selected from an aroma, a flavorant, a precursor of a flavorant, or a mixture thereof and preferably of natural origin, and such as may be used for aromatized-headspace packaged products. The aroma may be similar to that of the food product in the package, e.g. meaty aroma for a meat product such as charcuterie. Alternatively, the aroma may be different from that of the food product and plural separate cavities may be employed to contain differing aroma compositions for release upon opening to provide a combined aroma, and as is believed also apparent from the foregoing, the aroma composition(s) used need not be soluble or mixable in gaseous food-acceptable inert gas.

For certain types of food products, such as a charcuterie product, or dough products including, in particular, what are known as "fresh" pasta products, it may be desirable to pack the product in a modified atmosphere in order to prolong product shelf-life. The introduction of the modified atmosphere into the food product cavity headspace may be accomplished by means already known to those skilled in the art by firstly evacuating the air from the package followed by the introduction of a gas or gases to provide the modified atmosphere. Evacuating air from the package is accomplished by pulling a vacuum, such as discussed above, and in the context of the present invention, the vacuum is pulled advantageously simultaneously on the cavity which contains the food product and the cavity which contains the dosed mixture of aroma and solvent while evaporating the solvent. As is known in the art, a modified atmosphere may comprise of carbon dioxide or nitrogen or a mixture thereof, e.g. 20% $CO_2$ and 80% $N_2$.

Packages according to the invention may conveniently be formed in commercially available gas packing machines, e.g. automatic, semi-automatic or manual vacuum/modified atmosphere packing machines, such as MULTIVAC, TIROMA, DIXIE UNION machines, etc. Commercially available gas mixers which are suitable and can be used for carrying out the invention are such as gas mixers from ALAFAX and MULTIVAC.

Additionally, the present invention is not limited to the packing of food products and as referred to above, the invention also may be usefully employed for packaged beverages, and to the extent not made explicit above, considerations concerning the package described above are applicable also to the method according to the invention, and the present invention is described and illustrated further with reference to the accompanying drawings by way of example only.

BRIEF DESCRIPTION OF THE DRAWING FIGURES

Figure 1B:
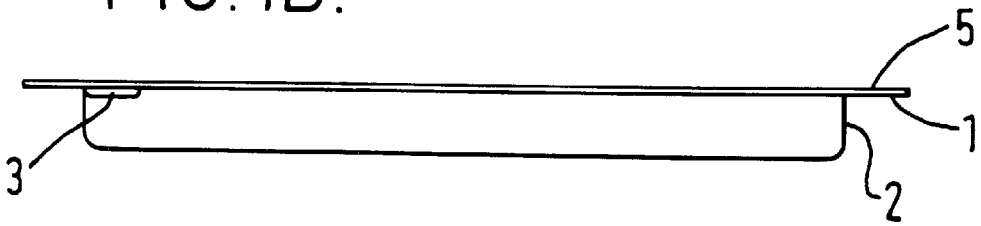

FIGS. 1A and 1B schematically illustrate a food package according to the invention wherein the aroma is released upon removing of a cover.

Figure 2A:
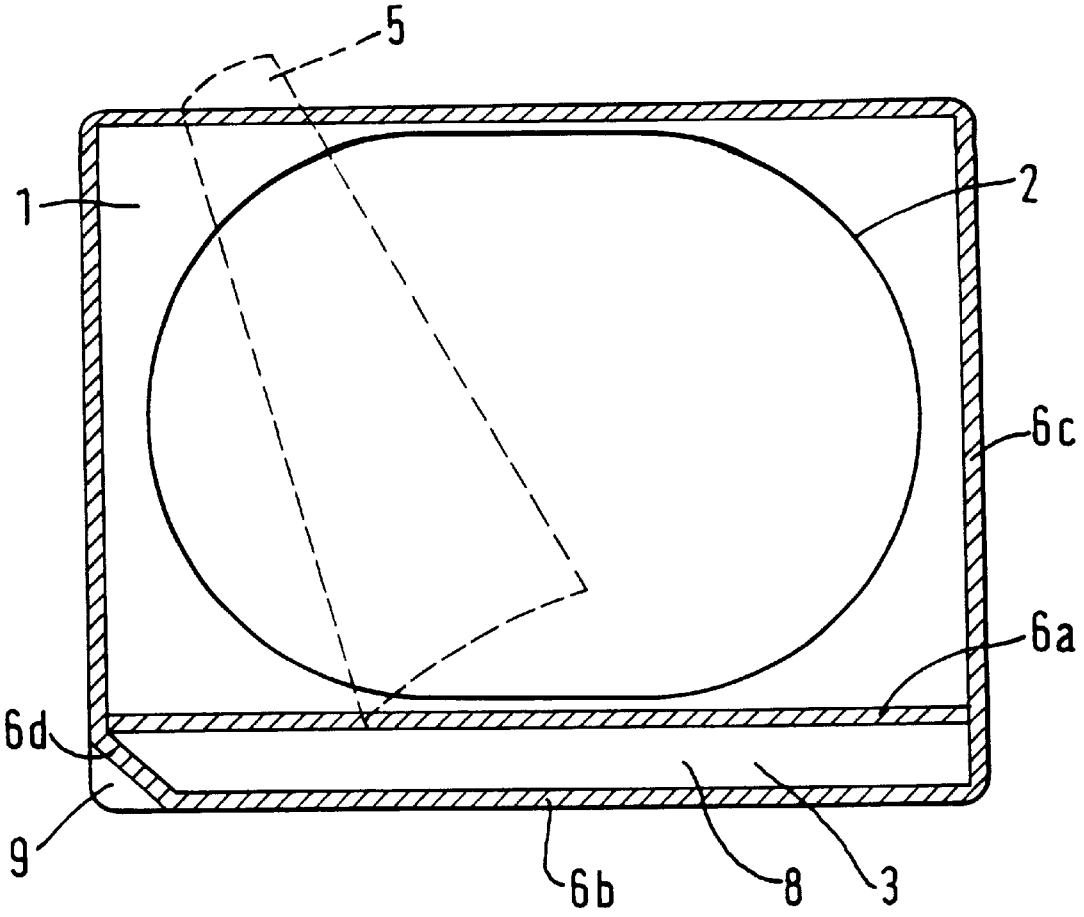
Figure 2B:
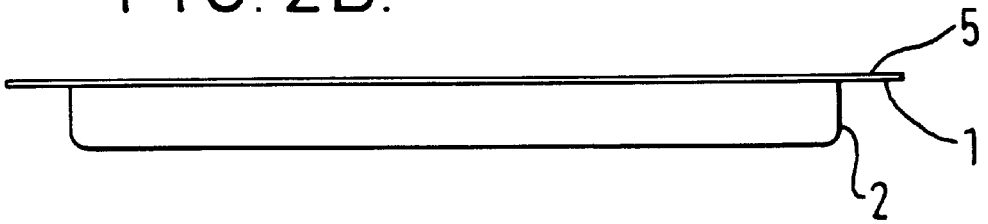

FIGS. 2A and 2B schematically illustrate another embodiment of a food package according to the invention.

DETAILED DESCRIPTION OF THE DRAWING FIGURES

FIG. 1A shows a top view of a food package embodiment according to the invention which comprises a package body member part 1 defining a first cavity 2 suitable for containing a food product (not shown in the drawing) and a second cavity 3. The second cavity is suitable for containing a food-acceptable aroma. As illustrated and as a preferable embodiment, the second cavity is formed and positioned in a corner 7 of the package which facilitates cavity opening. Cover 5, such as a peelable web, provides for sealing the first cavity 2 and second cavity 3 (shown as partly removed) so that they are sealed separate and apart and isolated imperviously. More particularly, the web is removably attached to the upper flanges of the body member part 1 by means of portions of sealings 6*a*, 6*b*, and 6*c*. The portions of sealings 6*b*, 6*c* define the closed contour of the second cavity while portions 6*a*, 6*b* define the closed contour of the first cavity. The portions of sealings 6*a*, 6*b*, 6*c* are all peelable to permit removal of the web from the package body member part. Preferably, the cover is peeled from the corner 7 in a manner to uncover firstly the second cavity 4 with the aroma, then to uncover the cavity containing the food product, and as illustrated in FIG. 1A, the package cover member part 5 is removed from the second cavity 4 and partly removed from the body member part 1, which is the manner so that the food-acceptable aroma is released together with the aroma from the food product.

FIG. 1B shows a side view of the package without the cover 5 being peeled off.

In another embodiment of the invention, shown in FIGS. 2A and 2B, a first cavity 2 is formed in a body member part 1. A second cavity 3 is an un-sealed area 8 between a portion of an upper flange of the body member part 1 and a cover 5. The body member part 1 and the cover being joined by portions of sealings 6*a*, 6*b*, and 6*c* which demarcate the outer contour of the cavity 2 for the food product. The portion of upper flange which comprises an unsealed area may be substantially flat or may comprise a slight concave shape to received the aroma. The portion of the upper flange is so delimited by portions of sealings 6*a*, 6*b*, and 6*d* which together demarcate a closed unsealed area 8 for the aroma. In the unsealed area 8, the aroma is deposited on the upper flange and the cover 5 is sealed thereto. An unsealed non-closed area 9 adjacent to the unsealed closed area 8 may be provided in one corner of the flange to be gripped by hand so as to allow for an easy releasing of the cover 5 from the package member part 1 by pulling.

As is clear from the foregoing, various modifications of the present invention may be made without departure form the spirit and scope of the disclosure and description, and the invention may be embodied and/or practiced suitably in the absence of and/or to the exclusion of physical structure and/or process steps and/or manipulations, conditions, substances employed, present and/or manipulated, and/or limitations not specifically disclosed therein.

I claim:

1. A process for preparing a packaged food or beverage product with packaged aroma comprising:

providing a package body member part configured to define a first cavity suitable for containing a product selected from the group consisting of food and beverage products and to define a second cavity suitable for containing an aroma composition;

inserting a product selected from the group consisting of food and beverage products into the first cavity;

dosing into the second cavity a liquid carrier which contains food-acceptable aroma composition wherein the aroma composition is one which upon removal of the carrier and isolation of the composition from the carrier, comprises a residue which has a non-flowable form and is effective for producing an olfactory response under standard atmospheric and pressure conditions;

removing the liquid carrier from the aroma composition within the second cavity to obtain an aroma composition residue in the second cavity; and sealing the cavities with a cover so that the cavities are isolated one from the other and so that the cover is removable and so that when the cover is removed, both cavities are opened to the atmosphere.

2. A process according to claim 1 wherein the liquid carrier is a low-boiling point solvent and is removed from the cavity by pulling a vacuum on the second cavity so that the solvent evaporates.

3. A process according to claim 2 wherein the low-boiling point solvent is selected from the group consisting of ethanol, methylformate, ethylformate, propanol and hexane.

4. A process according to claim 1 or 3 wherein the liquid carrier containing the aroma compositions dosed in a dose amount of from about 3 to 50 microliters.

5. A process according to claim 4 wherein the liquid carrier containing the aroma composition is dosed in a dose amount of from about 5 to 10 microliters and wherein the aroma composition of the dose amount is in an amount from about 1 to 10% by volume of the dose amount.

6. A process according to claim 2 wherein the vacuum is pulled simultaneously in both first and second cavities.

7. A process according to claim 2 wherein the vacuum is pulled at a pressure not higher than about 0.1 bar.

8. A process according to claim 1 or 2 or 6 further comprising after removing the carrier, displacing the atmosphere of the first cavity with a food-acceptable protective gas to obtain a modified atmosphere and then covering and sealing the package body part so that the modified atmosphere and product are contained in the first cavity.

9. A process according to claim 2 wherein the pressure is not higher than about 0.05 bar.

10. A process for preparing an aromatized packaged food or beverage product with packaged aroma comprising:

providing a package body part and a cover part to prepare a sealed package wherein the package body part is configured to define a cavity for containing a product selected from the group consisting of food and beverage products and wherein the body part and cover part are configured further so that the body part has a flange surface portion so that when the body part is covered by the cover part, the cover part covers and seals the cavity and the cover part and flange surface portion form a second cavity which is suitable for containing a food-acceptable aroma composition sealed separate and apart from the product;

inserting a product selected from the group consisting of food and beverage products into the package body food product cavity;

dosing a liquid carrier which contains a food-acceptable aroma composition onto the flange surface portion to obtain a dose on the portion which is separate and apart from the package body part food cavity and wherein the aroma composition is one which upon removal of the carrier and isolation of the composition from the carrier, comprises a residue which has a non-flowable form and is effective for producing an olfactory response under standard atmospheric and pressure conditions;

removing the liquid carrier from the aroma composition to obtain an aroma composition residue on the body portion part; and covering and sealing the package body part with the cover part so that the aroma composition is contained between the cover part and flange surface portion and sealed in a cavity so that the product in the package body part cavity and the aroma composition on the flange surface portion are sealed and contained within the package separate and apart one from the other and from the atmosphere and so that the cover is removable and so that when the cover part is removed, the separate cavities are opened to the atmosphere.

11. A process according to claim 10 wherein the carrier is evaporated for removing the carrier.

12. A process according to claim 10 wherein the liquid carrier is a low-boiling point solvent and is removed from the cavity by subjecting the dose on the flange surface portion to a vacuum so that the solvent evaporates.

13. A process according to claim 12 wherein the low-boiling point solvent is selected from the group consisting of ethanol, methylformate, ethylformate, propanol and hexane.

14. A process according to claim 10 or 13 wherein the liquid carrier containing the aroma composition is dosed in a dose amount of from about 3 to 50 microliters.

15. A process according to claim 14 wherein the liquid carrier containing the aroma composition is dosed in a dose amount of from about 5 to 10 microliters and wherein the aroma composition of the dose amount is in an amount from about 1 to 10% by volume of the dose amount.

16. A process according to claim 12 wherein the dose is subjected to a vacuum at a pressure not higher than about 0.1 bar.

17. A process according to claim 16 wherein the pressure is not higher than about 0.05 bar.

18. A process according to claim to 10 further comprising, after removing the carrier, displacing the atmosphere of the body part cavity with a food-acceptable protective gas to obtain a modified atmosphere and then covering and sealing the package body part so that the modified atmosphere and food product are contained in the cavity.

* * * * *

UNITED STATES PATENT AND TRADEMARK OFFICE

CERTIFICATE OF CORRECTION

PATENT NO. : 6,294,209 B1
DATED : September 25, 2001
INVENTOR(S) : Andersson

It is certified that error appears in the above-identified patent and that said Letters Patent is hereby corrected as shown below:

Column 9,
Line 5, change "compositions" to -- composition is --

Signed and Sealed this

Twelfth Day of March, 2002

*Attest:*

*Attesting Officer*

JAMES E. ROGAN
*Director of the United States Patent and Trademark Office*